US006804847B2

(12) United States Patent
Grothaus

(10) Patent No.: US 6,804,847 B2
(45) Date of Patent: Oct. 19, 2004

(54) POCKETED SPRING CORE

(75) Inventor: Wolfgang Grothaus, Bad Essen (DE)

(73) Assignee: Agro Federkernproduktions GmbH, Bad Essen-Wittlage (DE)

( * ) Notice: Subject to any disclaimer, the term of this patent is extended or adjusted under 35 U.S.C. 154(b) by 0 days.

(21) Appl. No.: 10/437,148

(22) Filed: May 13, 2003

(65) Prior Publication Data

US 2003/0217413 A1 Nov. 27, 2003

Related U.S. Application Data

(60) Provisional application No. 60/382,976, filed on May 24, 2002.

(51) Int. Cl.[7] ..... A47C 17/06

(52) U.S. Cl. ..... 5/655.8; 5/720; 5/727; 5/716

(58) Field of Search ..... 5/655.8, 720, 716, 5/246, 727; 267/91–93, 80

(56) References Cited

U.S. PATENT DOCUMENTS 6,374,442 B1 * 4/2002 Wells ..... 5/720

* cited by examiner

*Primary Examiner*—Teri Pham Luu
*Assistant Examiner*—Fredrick Conley
(74) *Attorney, Agent, or Firm*—Henry M. Feiereisen

(57) ABSTRACT

A pocketed spring core includes a plurality of springs which are arranged sequentially in rows to form parallel adjoining spring strands, wherein each of the springs is supported in a pocket made of flexible material. A first cover sheet is placed over and connected to the spring strands, and a second cover sheet is placed under the spring strands and connected thereto. At least one of the first and second cover sheets has predetermined regions which are opened in a direction transversely to a longitudinal extension of the spring strands by a plurality of slots to thereby form strips.

26 Claims, 1 Drawing Sheet

POCKETED SPRING CORE

CROSS-REFERENCES TO RELATED APPLICATIONS

This application claims the benefit of prior filed U.S. provisional Application No. 60/382,976, filed May 24, 2002, pursuant to 35 U.S.C. 119(e), the disclosure of which is incorporated herein by reference.

BACKGROUND OF THE INVENTION

The present invention relates, in general, to the field of pocketed spring cores.

In general, a pocketed spring core has a plurality of springs which are each supported in a pocket made of flexible material, normally textile material, wherein several springs arranged sequentially in a row form a spring strand extending typically in longitudinal direction of the spring core. The adjoining spring strands are disposed in parallel relationship and have a top and a bottom which are each covered by a cover sheet of flexible material in order to provide a connection of the individual spring strands. The cover sheets are normally glued to the spring strands and are made from a textile material, for example fleece. Also the envelopes of the individual springs are normally made from a textile material. Pocketed spring cores offer essential advantages compared to so-called Bonell spring cores as far a resting comfort is concerned, because the individual springs are supported independently from one another in respective pockets which form an envelope and are predominantly made of a fleece.

Since the provision of the cover sheet results in an adherence of the spring strands and thus of the individual springs, although not directly, problems are encountered with respect to a point elasticity. As a spring is exposed to pressure, also neighboring springs become compressed. In other words, the immediate surrounding area of the spring is directly affected as well as some areas farther away. This spring behavior is counterproductive to an optimum resting comfort.

It would therefore be desirable and advantageous to provide an improved pocketed spring core to obviate prior art shortcomings and to provide a better resting comfort.

SUMMARY OF THE INVENTION

According to one aspect of the present invention, a pocketed spring core includes a plurality of springs arranged sequentially in rows to form parallel adjoining spring strands, wherein each of the springs is supported in a pocket made of flexible material, a first cover sheet placed over and connected to the spring strands, and a second cover sheet placed under the spring strands and connected thereto, wherein at least one of the first and second cover sheets has predetermined regions which are opened in a direction transversely to a longitudinal extension of the spring strands by a plurality of slots to thereby form strips.

This configuration of a pocketed spring core according to the present invention significantly improves the point elasticity compared to a closed cover sheet. The cover sheet may be slit across the entire width of the pocketed spring core, whereby the longitudinal extension of the spring strands corresponds overall to the length of the pocketed spring core. The width of the strips resultant by the partition corresponds preferably to the relative distance between the individual pockets and thus the springs accommodated therein, whereby the strips extend in parallel relationship. Of course, it is also possible to partially open the cover sheets across the width of the pocketed spring core as well as also in its length, so that different point elasticities can be realized.

In a pocketed spring core of so-called king size, the areas intended for two users can thus be individually configured and conformed to the individual demands. Hereby, the provision of slots can be omitted in the outer marginal area of the cover sheet as well as also in a center area thereof, while the area defining the resting area is respectively slit.

The point elasticities can be made different across regions not only through selection of the width of the strips and their length, as described above, but also through provision of different hardness by changing the wire strength and/or windings of the springs. Thus, it is possible to provide a greater hardness, in the marginal area of the spring core than in the inner region thereof.

Compared to pocketed spring cores which lack the provision of cover sheets and have spring strands that are directly interconnected, a pocketed spring core according to the present invention has the advantage that a sinking into the gaps between the individual spring strands is precluded. The pocketed spring core according to the present invention thus combines the advantages of the conventional pocketed spring core with cover sheets as well as those of a pocketed spring core without cover sheet. In addition, there is no need to apply additional cover material and upholstery material can sink in as a result of the crossed interconnection between the spring strands, on the one hand, and the strips extending transversely thereto, on the other hand.

As the pocketed spring core according to the invention can be made substantially fully automated, the manufacturing process is very cost-effective.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
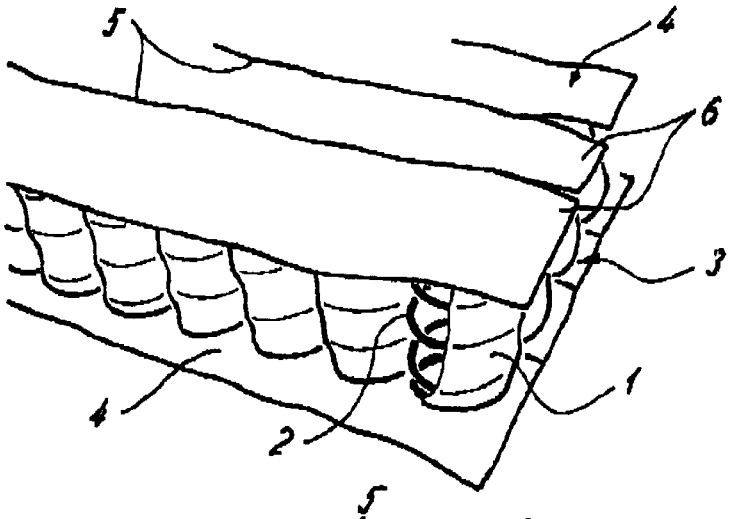
FIG. 1 is a perspective view of a first embodiment of a pocketed spring core according to the invention.

Throughout all the Figures, same or corresponding elements are generally indicated by same reference numerals. These depicted embodiments are to be understood as illustrative of the invention and not as limiting in any way.

Turning now to the drawing, and in particular to FIG. 1, there is shown a perspective view of a first embodiment of a pocketed spring core according to the invention, including a plurality of springs 2 which are each supported in a pocket 1 of flexible, e.g. textile material. The springs 2 are positioned sequentially in rows to form respective spring strands 3 in parallel relationship.

The spring strands 3 have a top and a bottom which are each covered by a cover sheet 4, whereby the cover sheets 4 are connected with the spring strands 3 through gluing. In this way, the spring strands 3 which are loosely positioned side-by-side can be held together. The upper and lower cover sheets 4 are slit transversely to the course of the spring strands 3 by slots 5 to thereby provide strips 6 in side-by-side disposition.

In the exemplified embodiment shown in FIG. 1, the width of such a strip 6 corresponds approximately to the distance between two springs 3 of a spring strand 3, whereby each slot 5 runs between two springs 2 of the spring strands 3 and extends across the entire width of the cover sheet 4.

Figure 2:
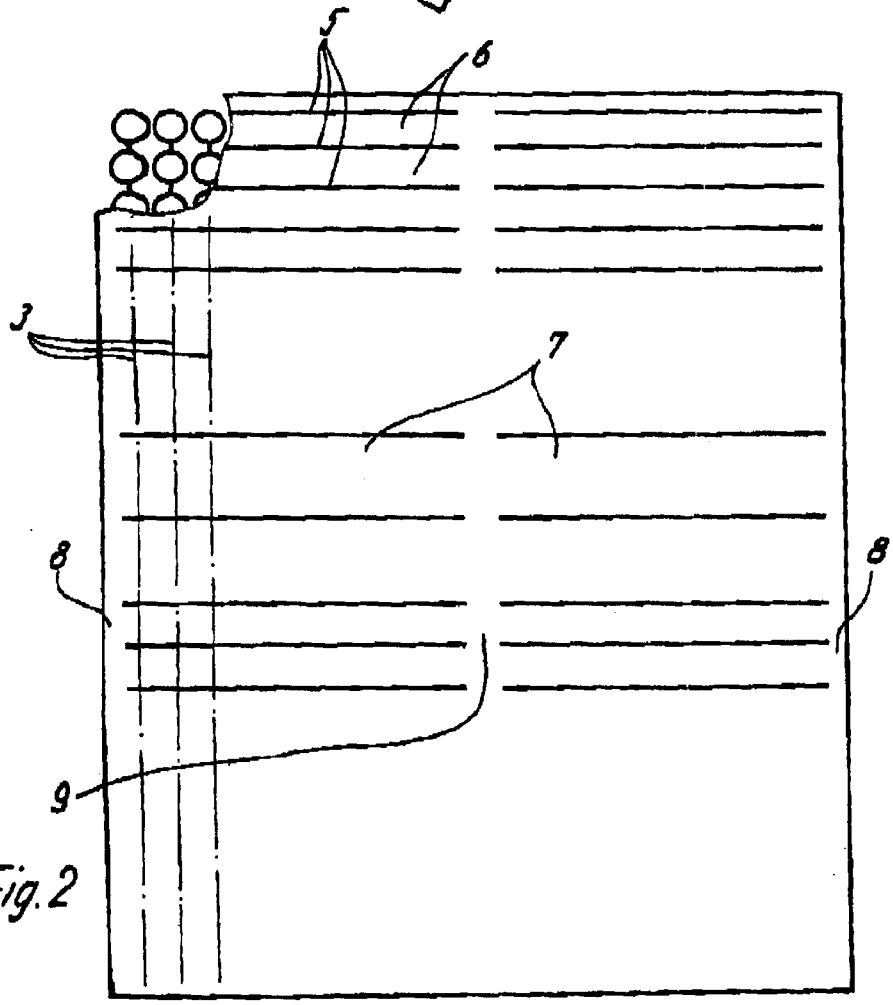
FIG. 2 is a plan view of a second embodiment of a pocketed spring core according to the invention.

FIG. 2 shows a plan view of a second embodiment of a pocketed spring core according to the invention which is part of a mattress of so-called king size. Such a mattress is suitable for use by two persons. The distances between the slots 5 relative to one another and thus the width of the strips 6 are essentially identical with the ones shown in FIG. 1. This embodiment differs from the embodiment of FIG. 1 by the absence of slots 5 in some regions so as to provide broader strips 7, whereby each strip 7 has a size sufficient to cover several neighboring springs 2. In this way, a zoning is created whose point elasticity differs from the other regions. As a consequence, the comfort of spring support can be suited to individual demands which are clearly demonstrated in FIG. 2 by the provision of the broader strips 7 in different zones.

Furthermore, the slots 5 are not continuous from one side of the pocketed spring core to the other side, but their length is so dimensioned as to form edges 8 at the margins and a central web 9, so that the option to provide individual spring characteristic between neighboring resting regions is maintained. In this way, regions of varying spring characteristic can be created at any location, whereby the point elasticity of the individual springs can further be changed by keeping the slots 5 of different length within the resting areas.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A pocketed spring core, comprising a plurality of springs arranged sequentially in rows to form parallel adjoining spring strands, wherein each of the springs is supported in a pocket made of flexible material; a first cover sheet placed over and connected to the spring strands; and a second cover sheet placed under and connected to the spring strands, wherein at least one of the first and second cover sheets has predetermined regions which are opened in a direction transversely to a longitudinal extension of the spring strands by a plurality of slots to thereby form strips, wherein the slots are spaced at a distance which corresponds at least to a distance between two springs of a spring strand.

2. The pocketed spring core of claim 1, wherein the pocket is made of textile.

3. The pocketed spring core of claim 1, wherein the first and second cover sheets are glued to the spring strands.

4. The pocketed spring core of claim 1, wherein each of the strips, bounded by slots, has a dimension to cover a spring of a spring strand.

5. The pocketed spring core of claim 1, wherein several springs of at least one spring strand are covered by a single said strip.

6. The pocketed spring core of claim 1, wherein the slots in each of the first and second cover sheets extend from end to end.

7. A pocketed spring core, comprising a plurality of springs arranged sequentially in rows to form parallel adjoining spring strands, wherein each of the springs is supported in a pocket made of flexible material; a first cover sheet placed over and connected to the spring strands; and a second cover sheet placed under and connected to the spring strands, wherein at least one of the first and second cover sheets has predetermined regions which are opened in a direction transversely to a longitudinal extension of the spring strands by a plurality of slots to thereby form strips, wherein the slots in each of the first and second cover sheets extend partially across the cover sheets.

8. A pocketed spring core, comprising a plurality of springs arranged sequentially in rows to form parallel adjoining spring strands, wherein each of the springs is supported in a pocket made of flexible material; a first cover sheet placed over and connected to the spring strands; and a second cover sheet placed under and connected to the spring strands, wherein at least one of the first and second cover sheets has predetermined regions which are opened in a direction transversely to a longitudinal extension of the spring strands by a plurality of slots to thereby form strips, wherein the slots in each of the first and second cover sheets are so dimensioned as to leave an edge at the margin.

9. A pocketed spring core, comprising a plurality of springs arranged sequentially in rows to form parallel adjoining spring strands, wherein each of the springs is supported in a pocket made of flexible material; a first cover sheet placed over and connected to the spring strands; and a second cover sheet placed under and connected to the spring strands, wherein at least one of the first and second cover sheets has predetermined regions which are opened in a direction transversely to a longitudinal extension of the spring strands by a plurality of slots to thereby form strips, wherein the slots in each of the first and second cover sheets are so dimensioned as to leave a center web.

10. A pocketed spring core, comprising a plurality of springs arranged sequentially in rows to form parallel adjoining spring strands, wherein each of the springs is supported in a pocket made of flexible material; a first cover sheet placed over and connected to the spring strands; and a second cover sheet placed under and connected to the spring strands, wherein at least one of the first and second cover sheets has predetermined regions which are opened in a direction transversely to a longitudinal extension of the spring strands by a plurality of slots to thereby form strips, wherein the slots in each of the first and second cover sheets are so dimensioned as to leave an edge at the margin and a center web.

11. The pocketed spring core of claim 7, wherein the packet is made of textile.

12. The pocketed spring core of claim 7, wherein the first and second cover sheets are glued to the spring strands.

13. The pocketed spring core of claim 7, wherein each of the strips, bounded by slots, has a dimension to cover a spring of a spring strand.

14. The pocketed spring core of claim 7, wherein several springs of at least one spring strand are covered by a single said strip.

15. The pocketed spring core of claim 8, wherein the pocket is made of textile.

16. The pocketed spring core of claim 8, wherein the first and second cover sheets are glued to the spring strands.

17. The pocketed spring core of claim 8, wherein each of the strips, bounded by slots, has a dimension to cover a spring of a spring strand.

18. The pocketed spring core of claim 8, wherein several springs of at least one spring strand are covered by a single said strip.

19. The pocketed spring core of claim 9, wherein the pocket is made of textile.

20. The pocketed spring core of claim 9, wherein the first and second cover sheets are glued to the spring strands.

21. The pocketed spring core of claim 9, wherein each of the strips, bounded by slots, has a dimension to cover a spring of a spring strand.

22. The pocketed spring core of claim 9, wherein several springs of at least one spring strand are covered by a single said strip.

23. The pocketed spring core of claim 10, wherein the pocket is made of textile.

24. The pocketed spring core of claim 10, wherein the first and second cover sheets are glued to the spring strands.

25. The pocketed spring core of claim 10, wherein each of the strips, bounded by slots, has a dimension to cover a spring of a spring strand.

26. The pocketed spring core of claim 10, wherein several springs of at least one spring strand are covered by a single said strip.

* * * * *